US007163572B1

(12) United States Patent
Liang et al.

(10) Patent No.: US 7,163,572 B1
(45) Date of Patent: Jan. 16, 2007

(54) AIR PURIFIER

(75) Inventors: ZhuHuan Liang, LuoDing (CN); GuoSheng Huang, XinYi (CN)

(73) Assignee: Foshan Shunde Nasi Industry Co., Ltd., Guangdong (CN)

( * ) Notice: Subject to any disclaimer, the term of this patent is extended or adjusted under 35 U.S.C. 154(b) by 0 days.

(21) Appl. No.: 11/228,555

(22) Filed: Sep. 16, 2005

(51) Int. Cl.
*B03C 3/12* (2006.01)
*B03C 3/36* (2006.01)

(52) U.S. Cl. ..... 96/63; 96/75; 96/77; 96/80; 323/903

(58) Field of Classification Search ..... 96/75–80, 96/19, 21–24, 60–63, 88; 323/903; 55/DIG. 1, 55/DIG. 30
See application file for complete search history.

(56) References Cited

U.S. PATENT DOCUMENTS

| | | | | | |
|---|---|---|---|---|---|
| 2,489,786 | A | * | 11/1949 | Klemperer | 96/79 |
| 3,518,462 | A | * | 6/1970 | Brown | 310/10 |
| 4,189,308 | A | * | 2/1980 | Feldman | 95/75 |
| 4,643,745 | A | * | 2/1987 | Sakakibara et al. | 96/76 |
| 4,789,801 | A | * | 12/1988 | Lee | 310/308 |
| 5,037,456 | A | * | 8/1991 | Yu | 96/76 |
| 5,143,524 | A | * | 9/1992 | Inculet et al. | 15/347 |
| 5,466,279 | A | * | 11/1995 | Hattori et al. | 96/69 |
| 5,547,496 | A | * | 8/1996 | Hara | 96/79 |
| 5,603,752 | A | * | 2/1997 | Hara | 96/39 |
| 6,004,376 | A | * | 12/1999 | Frank | 95/79 |
| 6,312,507 | B1 | * | 11/2001 | Taylor et al. | 96/19 |
| 2006/0016336 | A1 | * | 1/2006 | Taylor et al. | 96/25 |

FOREIGN PATENT DOCUMENTS

| | | | | |
|---|---|---|---|---|
| JP | 52-33173 | * | 3/1977 | 96/77 |
| JP | 53-64877 | * | 6/1978 | 96/62 |
| JP | 54-136476 | * | 10/1979 | 96/79 |

* cited by examiner

*Primary Examiner*—Richard L. Chiesa
(74) *Attorney, Agent, or Firm*—Raymond Y. Chan; David and Raymond Patent Group

(57) ABSTRACT

An air purifier for removing particles in air includes an outer casing, and an ionizer module. The ionizer module includes a power unit and an ionizing electrode unit, electrically connected to the power unit. The ionizing electrode unit includes a first electrode set as an electrode terminal disposed within the outer casing at an air inlet, a second electrode set disposed within the outer casing at an air outlet, and a third electrode set disposed within the outer casing at a position between the first and second electrode set, wherein a voltage of the third electrode set is higher than a voltage of the first electrode set for drawing the air from the first electrode set to the second electrode set via the second electrode set while dirt particles contained in the air is trapped on the second and the third electrode sets.

23 Claims, 9 Drawing Sheets

AIR PURIFIER

BACKGROUND OF THE PRESENT INVENTION

1. Field of Invention

The present invention relates to an air purifier, and more particularly to an air purifier comprising a plurality of electrode sets which is capable of removing dirt from ambient air.

2. Description of Related Arts

A conventional air purifier usually comprises an outer casing, a power unit received in the outer casing, an ionizing electrode unit provided in the outer casing to electrically connect with the power unit, wherein the ionizing electrode unit comprises a plurality of electrode wires and a plurality of electrode blades spacedly mounted in the outer casing in such a manner that when a predetermined potential difference is applied across the electrode wires and the electrode blades, the air in the vicinity of the ionizing electrode unit is ionized to generate ozone.

During the course of operation of this conventional air purifier, electrostatics force is generated to draw air from the electrode wires to the electrode blades and during the course of air movement, dirt particles contained in the air will be electrostatically attracted on the electrode blades. However; when too much dirt particles are attached on the electrode blades, the ionizing reaction between the ambient air and the blade electrodes will be substantially retarded so that the overall performance of the air purifier will be severely affected.

This disadvantage leads to a phenomenon that the user of the above-mentioned conventional air purifier has to clean the electrode blades very frequently in order to ensure that the air purifier runs properly. Since the electrode blades are the only electrodes which are used in combination of the electrode wires to generate ozone, it is extremely important that the user cleans the electrode blades very frequently.

SUMMARY OF THE PRESENT INVENTION

A main object of the present invention is to provide an air purifier comprising a plurality of electrode sets which is capable of removing dirt from ambient air.

Another object of the present invention is to provide an air purifier comprising a plurality of electrode sets, wherein at least one of the electrode sets is arranged to draw air from electrode blades for removing dirt particles from ambient air.

Another object of the present invention is to provide an air purifier comprising a plurality of electrode sets for removing dirt particles from ambient air, wherein the air purifier of the present invention optimally and simultaneously releases ozone and removes dirt particles.

Another object of the present invention is to provide an air purifier comprising a plurality of electrode sets for removing dirt particles from ambient air, wherein the electrode sets does not substantially alter the structure of conventional air purifier, so that the present invention can be manufactured with minimum costs.

Accordingly, in order to accomplish the above objects, the present invention provides an air purifier for removing dirt particles in air, comprising:

an outer casing having an air purifying cavity, an air inlet and an air outlet communicating the air purifying cavity with an exterior of the outer casing;

an ionizer module for purifying the air and for generating ozone, which comprises:

a power unit supported within the outer casing; and an ionizing electrode unit, which is electrically connected to the power unit, comprising a first electrode set as an electrode terminal disposed within the outer casing at the air inlet, a second electrode set disposed within the outer casing at the air outlet, and a third electrode set disposed within the outer casing at a position between the first and second electrode set, wherein a voltage of the third electrode set is higher than a voltage of the first electrode set for drawing the air from the first electrode set to the third electrode set, and the voltage of the third electrode set is lower than a voltage of the second electrode set for accelerating the air from the third electrode set to the second electrode set, such that when the ionizing electrode unit is arranged for effectively drawing the air from the air inlet to the air outlet through the air purifying cavity, the third electrode set forms a first particles remover for electro-statically attracting the particles in the air while the second electrode set forms a second particle remover for electro-statically attracting the remaining particles left from the third electrode set so as to substantially purifying the air and to enhance an ozone level thereof.

These and other objectives, features, and advantages of the present invention will become apparent from the following detailed description, the accompanying drawings, and the appended claims.

DETAILED DESCRIPTION OF THE PREFERRED EMBODIMENT

Figure 1:
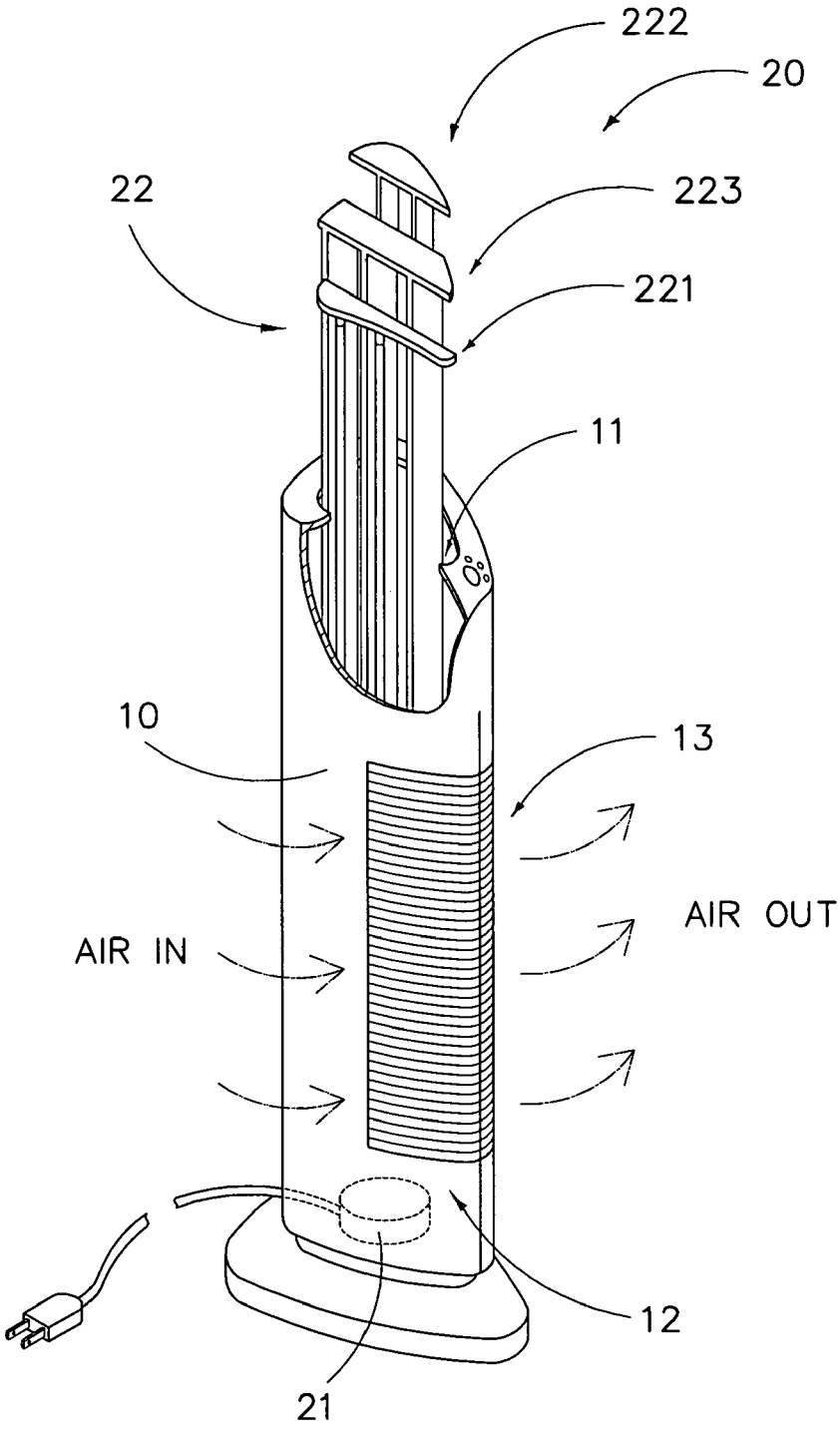
FIG. 1 is a perspective view of an air purifier according to a preferred embodiment of the present invention.
Figure 2A:
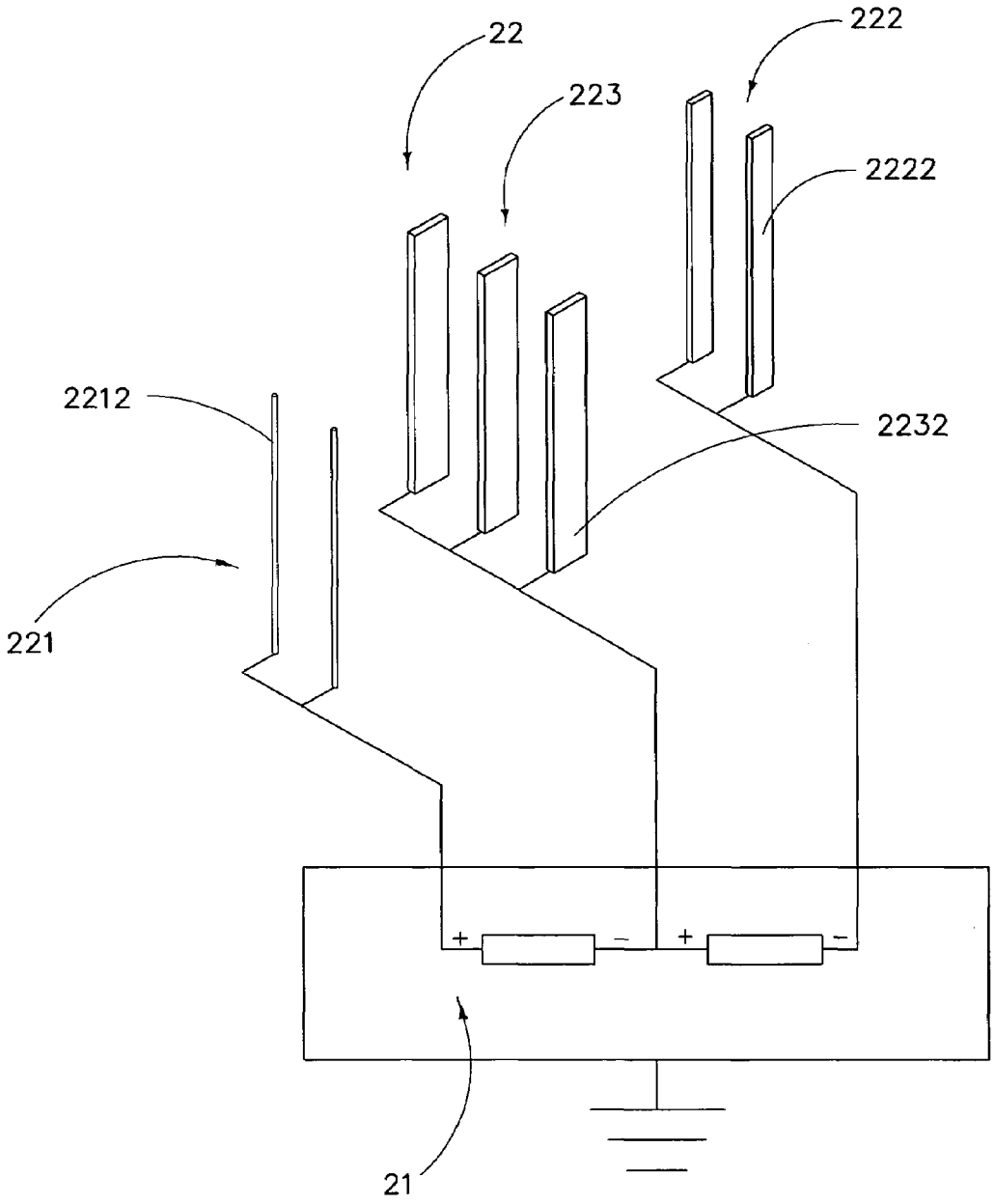
FIG. 2A and FIG. 2B are schematic diagrams of the air purifier according to the above preferred embodiment of the present invention.
Figure 2B:
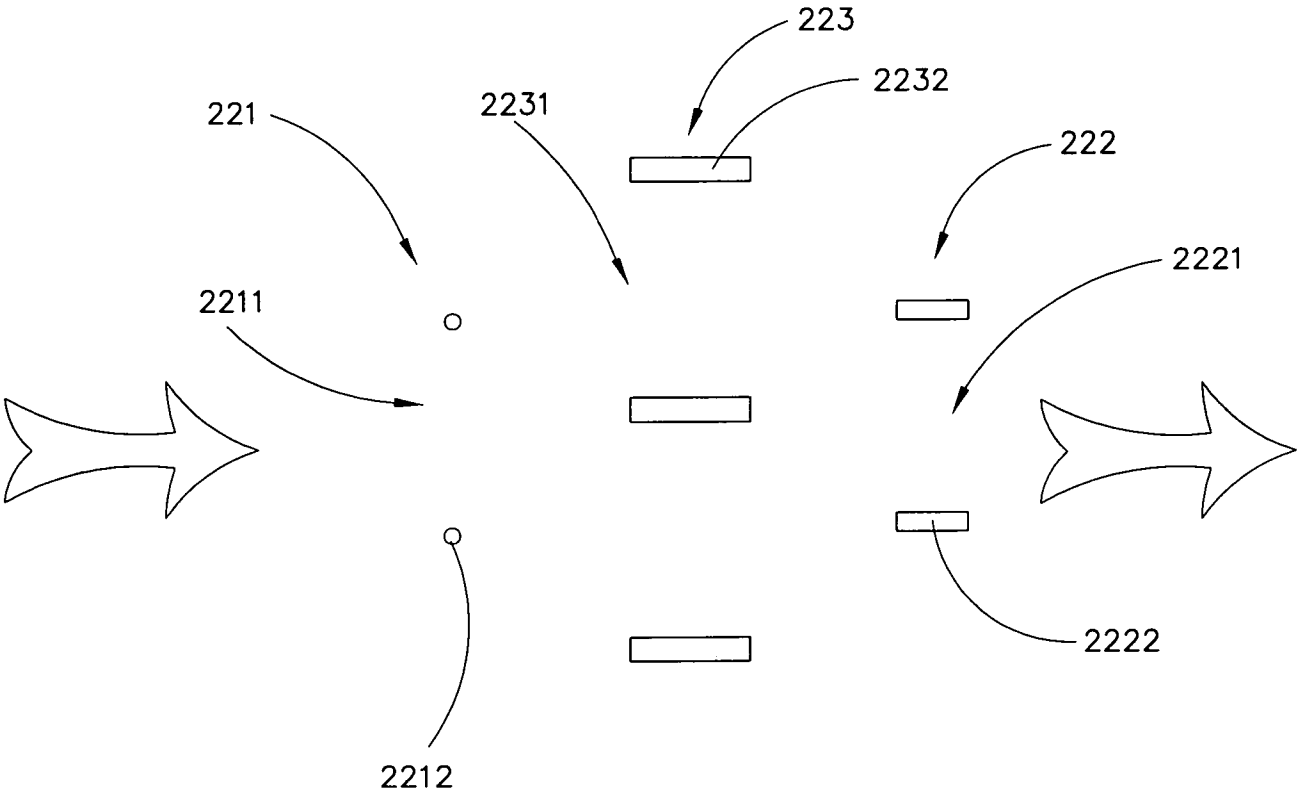

Referring to FIG. 1, FIG. 2A and FIG. 2B of the drawings, an air purifier for removing dirt particles according to a preferred embodiment of the present invention is illustrated, in which the air purifier comprises an outer casing 10, and an ionizer module 20.

The outer casing 10 has an air purifying cavity 11, an air inlet 12 and an air outlet 13 communicating the air purifying cavity 11 with an exterior of the outer casing 10.

On the other hand, the ionizer module 20 is for purifying the air and for generating ozone, wherein the ionizer module 20 comprises a power unit 21 supported within the outer casing 10, and an ionizing electrode unit 22.

The ionizing electrode unit 22, which is electrically connected to the power unit 21, comprising a first electrode set 221 as an electrode terminal disposed within the outer casing 10 at the air inlet 12, a second electrode set 222 disposed within the outer casing 10 at the air outlet 13, and a third electrode set 223 disposed within the outer casing 10 at a position between the first and second electrode set 221, 222, wherein a voltage of the third electrode set 223 is higher than a voltage of the first electrode set 221 for drawing the air from the first electrode set 221 to the third electrode set 223, and the voltage of the third electrode set 223 is lower than a voltage of the second electrode set 222 for accelerating the air from the third electrode set 223 to the second electrode set 222, such that when the ionizing electrode unit 22 is arranged for effectively drawing the air from the air inlet 12 to the air outlet 13 through the air purifying cavity 11, the third electrode set 223 forms a first particles remover for electrostatically attracting the particles in the air while the second electrode set 222 forms a second particle remover for electro-statically attracting the remaining particles left from the third electrode set 223 so as to substantially purify the air and to enhance an ozone level thereof.

According to the preferred embodiment of the present invention, the power unit 21 is electrically connected with the first through third electrode set 221, 222, 223 to apply predetermined potential differences between the first and the second electrode set 221, 222, and between the second and the third electrode set 222, 223 for ionizing air in within the air purifying cavity 11.

More specifically, the second electrode set 222 is spacedly provided from the first electrode set 221 while the third electrode set 223 is spacedly provided from the second electrode set 222 so as to produce ionizing effect between the first electrode set 221 and the second electrode set 222, and between the second electrode set 222 and the third electrode set 223.

According to the preferred embodiment of the present invention, the first electrode set 221 comprises a plurality of first electrode elements 2212 spacedly formed in an array to define a first air channel 2211 between each two first electrode elements 2212, wherein the second electrode set 222 comprises a plurality of second electrode elements 2222 spacedly formed in an array to define a second air channel 2221 between each the two second electrode elements 2222, wherein the third electrode set 223 comprises a plurality of third electrode elements 2232 spacedly formed in an array to define a third air channel 2231 between each the two third electrode elements 2232, wherein the number of the first elements 2212 is equal to the number of the second elements 2222. According to the preferred embodiment of the present invention, at least one of the third electrode elements 2232 is aligned with one of the first air channels 2211.

Each of the first electrode elements 2212 is an electrode wire supported within the air purifying cavity 11 at the air inlet 12, wherein each of the second electrode elements 2222 is a second electrode blade supported within the air purifying cavity 11 at the air outlet 13, wherein each of the third electrode elements 2232 is a third electrode blade, having an electrode surface larger than an electrode surface of the second electrode blade, supported within the air purifying cavity 11 at a position between the electrode wire and the second electrode blades.

In other words, the first electrode set 221 comprises a plurality of electrode wires spacedly mounted in an array within the air purifying cavity 11, while the third electrode set 223 comprises a plurality of third electrode blades spacedly mounted in array within the air purifying cavity 11 and spacedly positioned away from the first electrode set 221. On the other hand, the second electrode set 222 comprises a plurality of second electrode blades spacedly mounted in array and spacedly positioned away from the third electrode set 223 in the vicinity of the air outlet 13 in such a manner that the high potential difference with respect to the second electrode set 222 is adapted to draw air in the vicinity of the third electrode set 223 flowing towards the second electrode set 222 while the dirt particles contained in the air is electrostatically attracted to deposit on the second electrode set 222 so as to remove the dirt particles from the air which is then discharge out of the air purifier via the air outlet 13.

It is worth mentioning that the potential difference between the first electrode set 221 and the second electrode set 222, and between the second electrode set 222 and the third electrode set 223 have to be carefully selected in order to ensure optimal ionizing of the air within the air purifying cavity 11 and the removal of the dirt particles. More specifically, the first through third electrode set 221, 222, 223 are electrically arranged in such a manner that the third electrode set 222 is negative with respect to the first electrode set 221, while the third electrode set 222 is positive with respect to the second electrode set 223.

According to the preferred embodiment of the present invention, the electrical level of the third electrode set 223 is doubled of that of the first electrode set 221 so as to constitute a predetermined potential difference between the first electrode set 221 and the third electrode set 223, wherein the electrical level of the second electrode set 222 is doubled of that of the third electrode set 223 so as to constitute a predetermined potential difference between the first electrode set 221 and the third electrode set 223, and between the third electrode set 223 and the second electrode set 222.

In other words, a potential difference between the first and second electrode sets 221, 222 is at least two times more than a potential difference between the first and third electrode sets 221, 223, such that the first and third electrode sets 221, 223 are adapted for drawing the air through the air inlet 12 while the third and second electrode sets 222, 223 are adapted for accelerating the air towards the air outlet 13.

Referring to FIG. 2A and FIG. 2B of the drawings, the first electrode set 221 and the third electrode set 223 are spaced apart from each other at a predetermined distance, while the third electrode set 223 and the second electrode set 222 are spaced apart from each other at another predetermined distance for facilitating optimal ionization of the air and dirt particles attraction. As an example, the distance between the first and the second electrode set 221, 222 is seven (7) centimeters while the third electrode set 223 is positioned between the first and the second electrode set 221, 222. Moreover, when the potential difference between the first and the third electrode set 221, 223 is 5 kV, then, according to the preferred embodiment of the present invention, the potential difference between the first and the second electrode set 221, 222 is at least 10 kV.

It is also worth mentioning that the first, second and third electrode sets 221, 222, 223 are detechably mounted to the outer casing 10, so as to allow the first, second and third electrode sets 221, 222, 223 to be selectively removed from the outer casing 10.

Figure 3A:
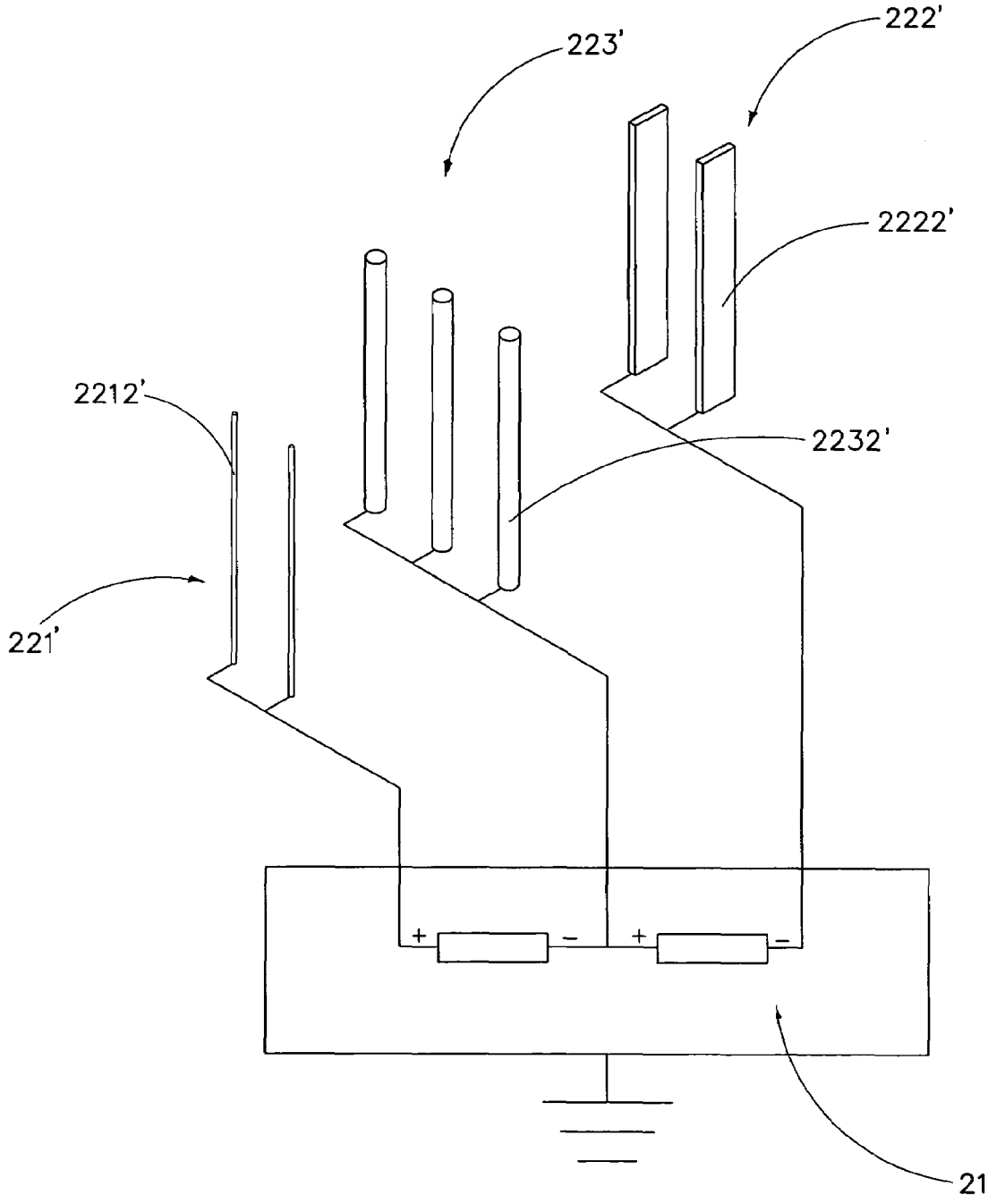
FIG. 3A and FIG. 3B illustrate first alternative mode of the air purifier according to the above preferred embodiment of the present invention.
Figure 3B:
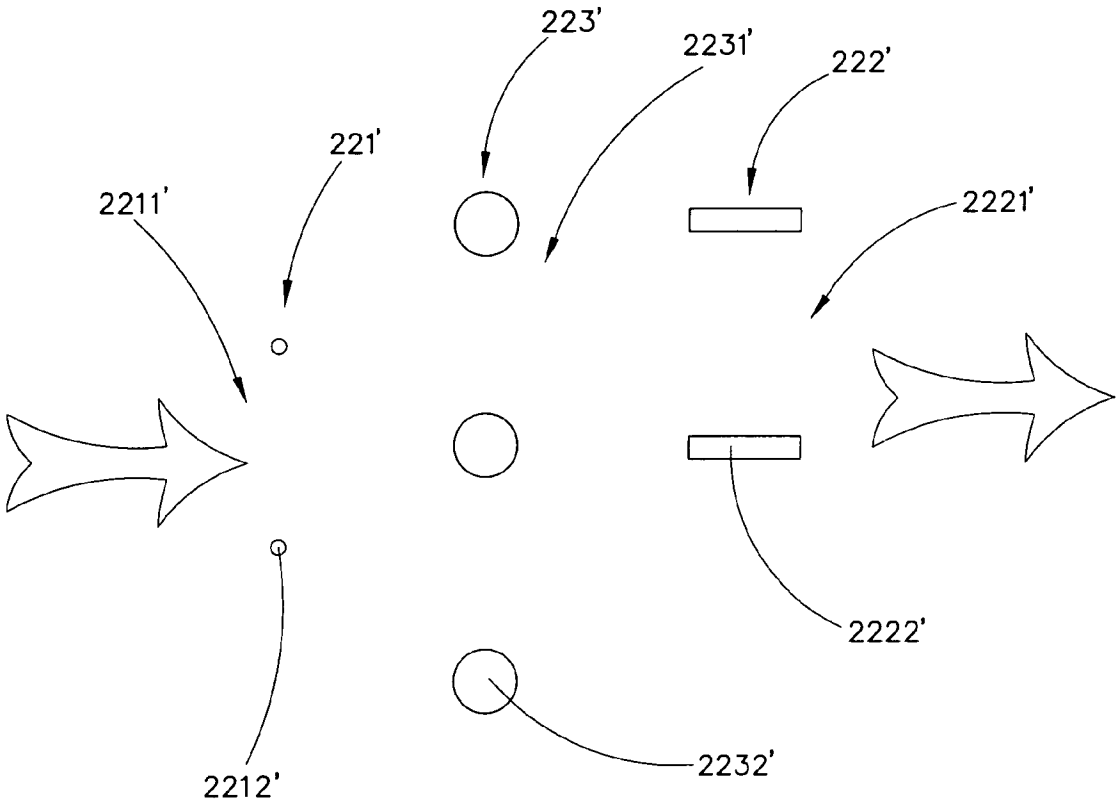

Referring to FIG. 3A and FIG. 3B of the drawings, a first alternative mode of the air purifier according to the above-mentioned preferred embodiment of the present invention is illustrated. The first alternative mode is similar to the preferred embodiment except the first through third electrode set 221', 222', 223'. According to the first alternative mode, each of the first electrode elements 2212' is an electrode wire supported within the air purifying cavity 11 at the air inlet 12, wherein each of the second electrode elements 2222' is an electrode blade supported within the air purifying cavity 11 at the air outlet 13, wherein each of the third electrode elements 2232' is an electrode shaft, having an electrode surface smaller than an electrode surface of the second electrode blade, supported within the air purifying cavity 11 at a position between the electrode wire and the electrode blade. Moreover, at least one of the second air channels 2221' is aligned with one of the third air channels 2231'.

In other words, the first electrode set 221' comprises a plurality of electrode wires spacedly mounted in array within the air purifying cavity 11, the second electrode set 222' comprises a plurality of second electrode blades spacedly mounted in array in the vicinity of the air outlet 13 and is spacedly apart from the first electrode set 221', while the third electrode set 223' comprises a plurality of electrode shafts spacedly mounted in array within the air purifying cavity 11 between the first and the second electrode set 221', 222', in such a manner that air is drawn from the first electrode set 221' to the second electrode set 222' via the third electrode set 223' in the similar fashion as in the preferred embodiment.

Figure 4A:
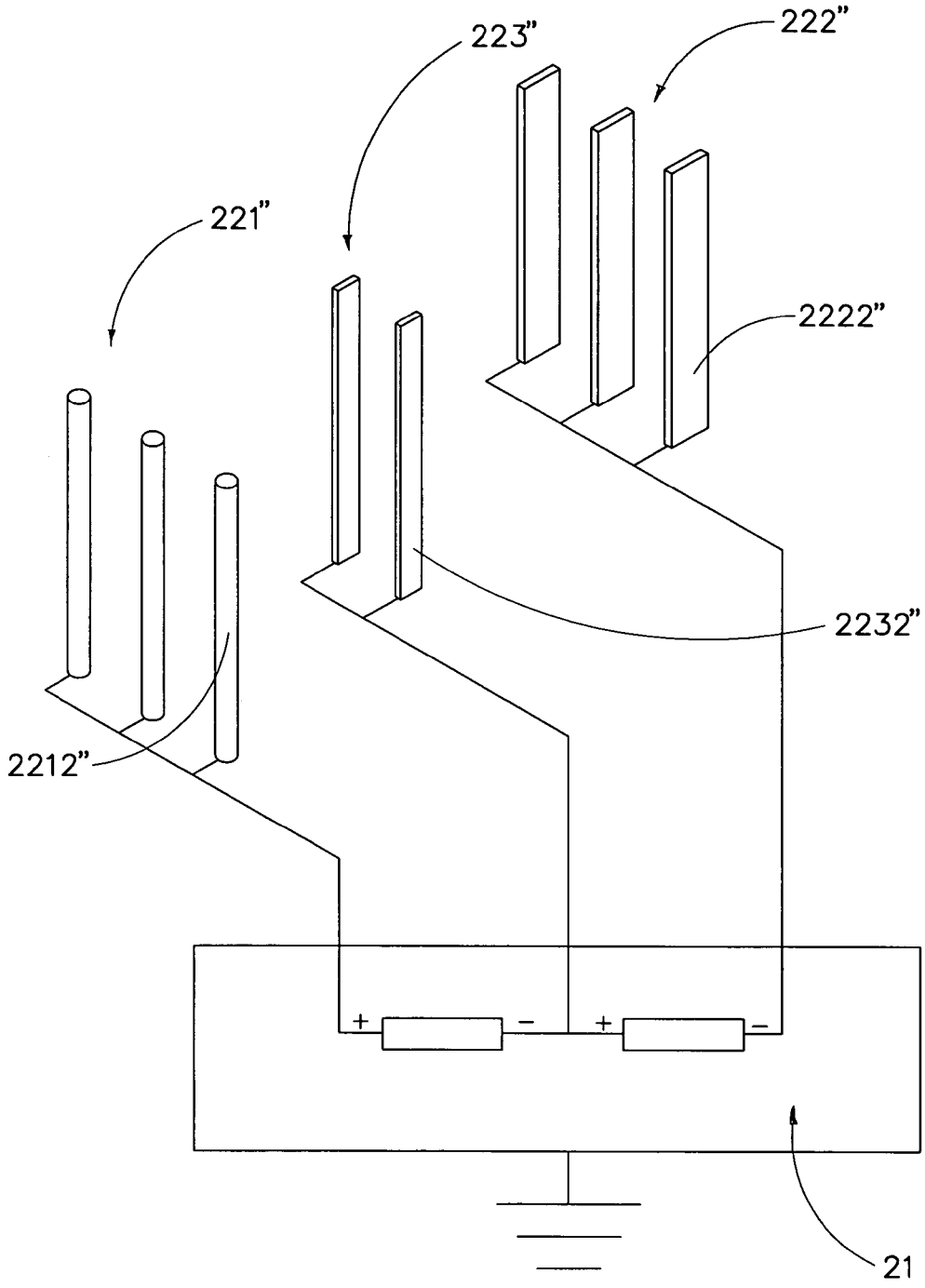
FIG. 4A and FIG. 4B illustrate second alternative mode of the air purifier according to the above preferred embodiment of the present invention.
Figure 4B:
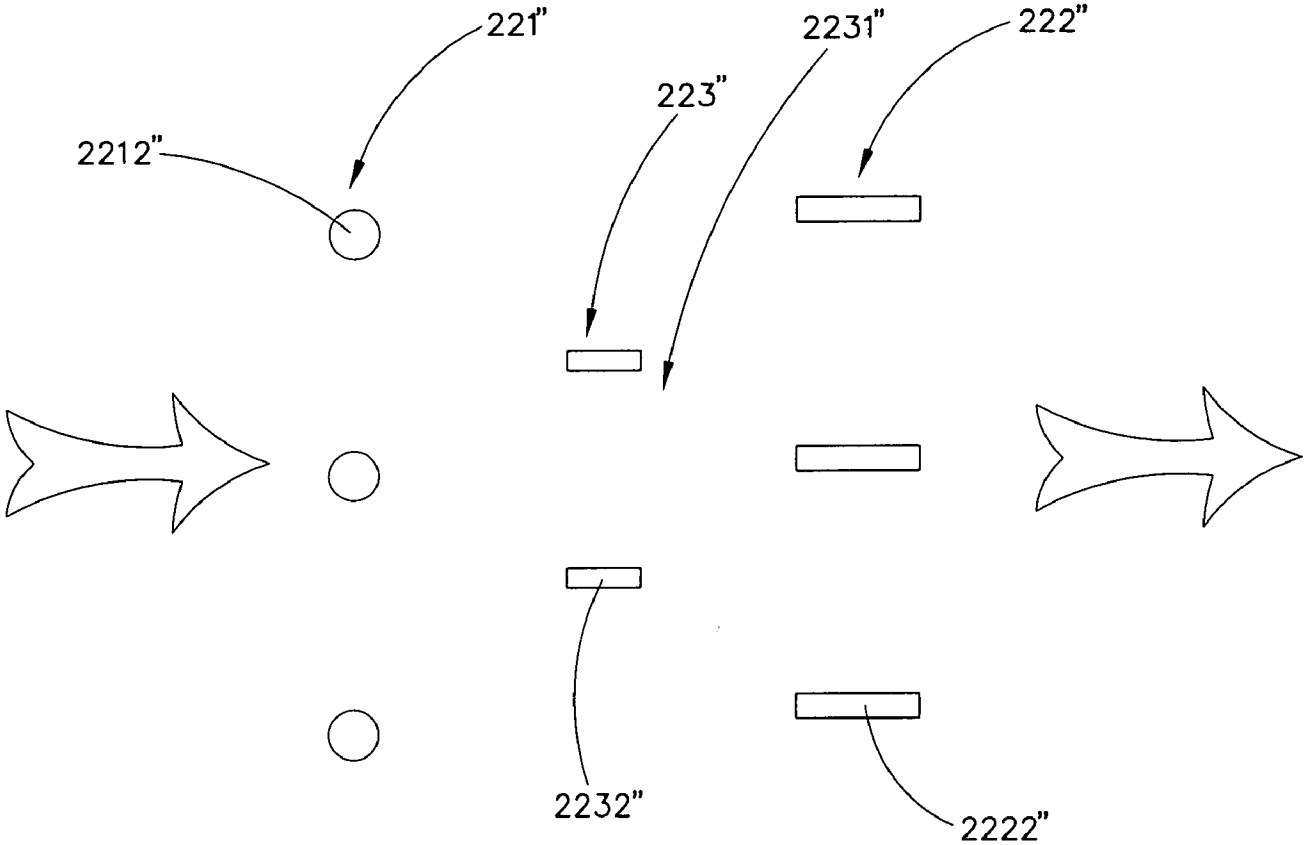

Referring to FIG. 4A and FIG. 4B of the drawings, a second alternative mode of the air purifier according to the above-mentioned preferred embodiment of the present invention is illustrated. The second alternative mode is similar to the preferred embodiment except the first through third electrode set 221", 222", 223". According to the second alternative mode, each of the first electrode elements 2212" is an electrode shaft supported within the air purifying cavity 11 at the air inlet 12, wherein each of the second electrode elements 2222" is a second electrode blade supported within the air purifying cavity 11 at the air outlet 13, wherein each of the third electrode elements 2232" is a third electrode blade, having an electrode surface smaller than an electrode surface of the second electrode blade, supported within the air purifying cavity 11 at a position between the electrode shaft and the second electrode blade. Moreover, at least one of the second electrode elements 2222" is aligned with one of the third air channels 2231".

In other words, the first electrode set 221" comprises a plurality of electrode shafts spacedly mounted in array within the air purifying cavity 11, the second electrode set 222" comprises a plurality of second electrode blades spacedly mounted in array in the vicinity of the air outlet 13 spacedly apart from the first electrode set 221", while the third electrode set 223" comprises a plurality of third electrode blades spacedly mounted in array within the air purifying cavity 11 between the first and the second electrode set 221", 222", in such a manner that air is drawn from the first electrode set 221" to the second electrode set 222" via the third electrode set 223" in the similar fashion as in the preferred embodiment.

Figure 5A:
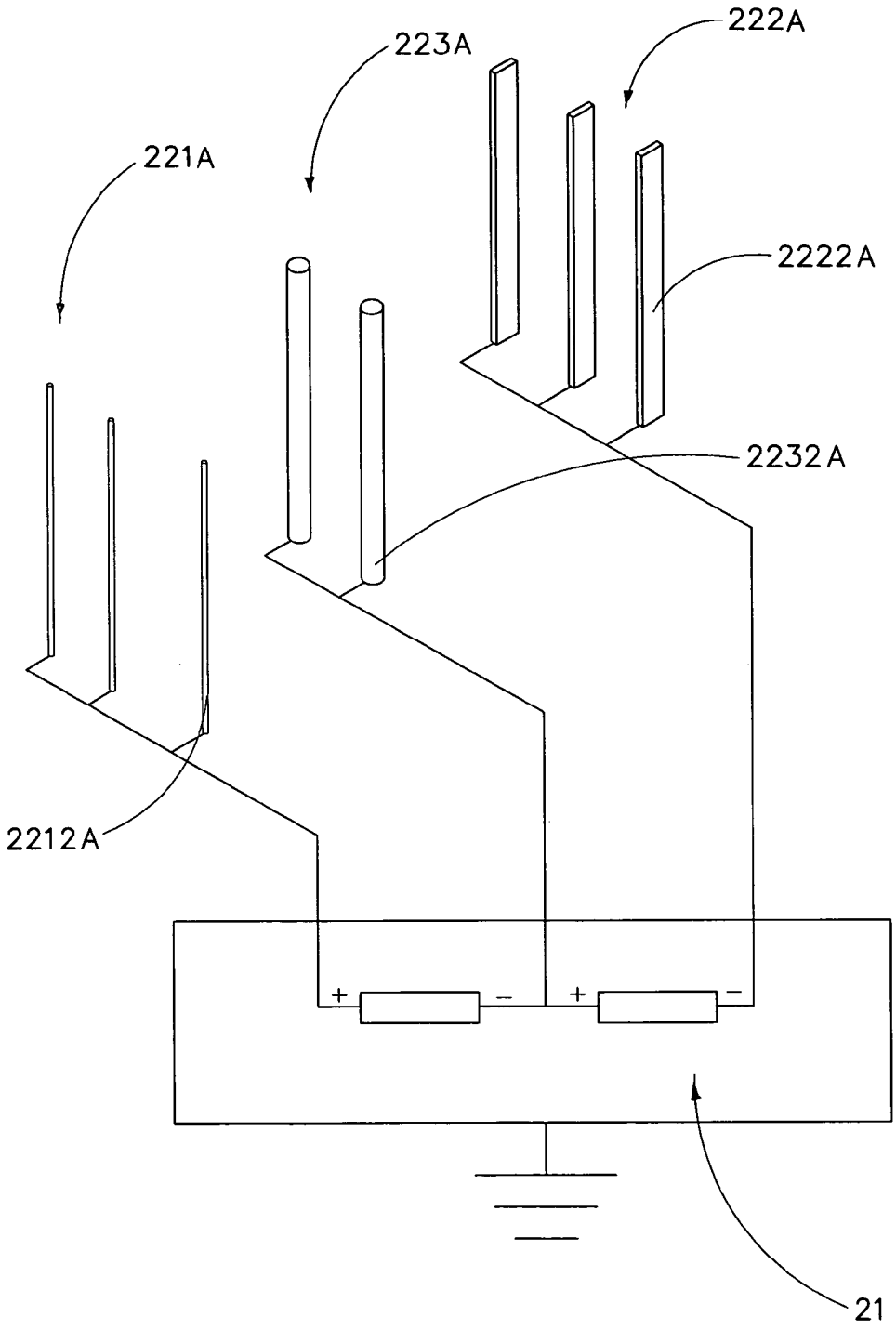
FIG. 5A and FIG. 5B illustrate third alternative mode of the air purifier according to the above preferred embodiment of the present invention.
Figure 5B:
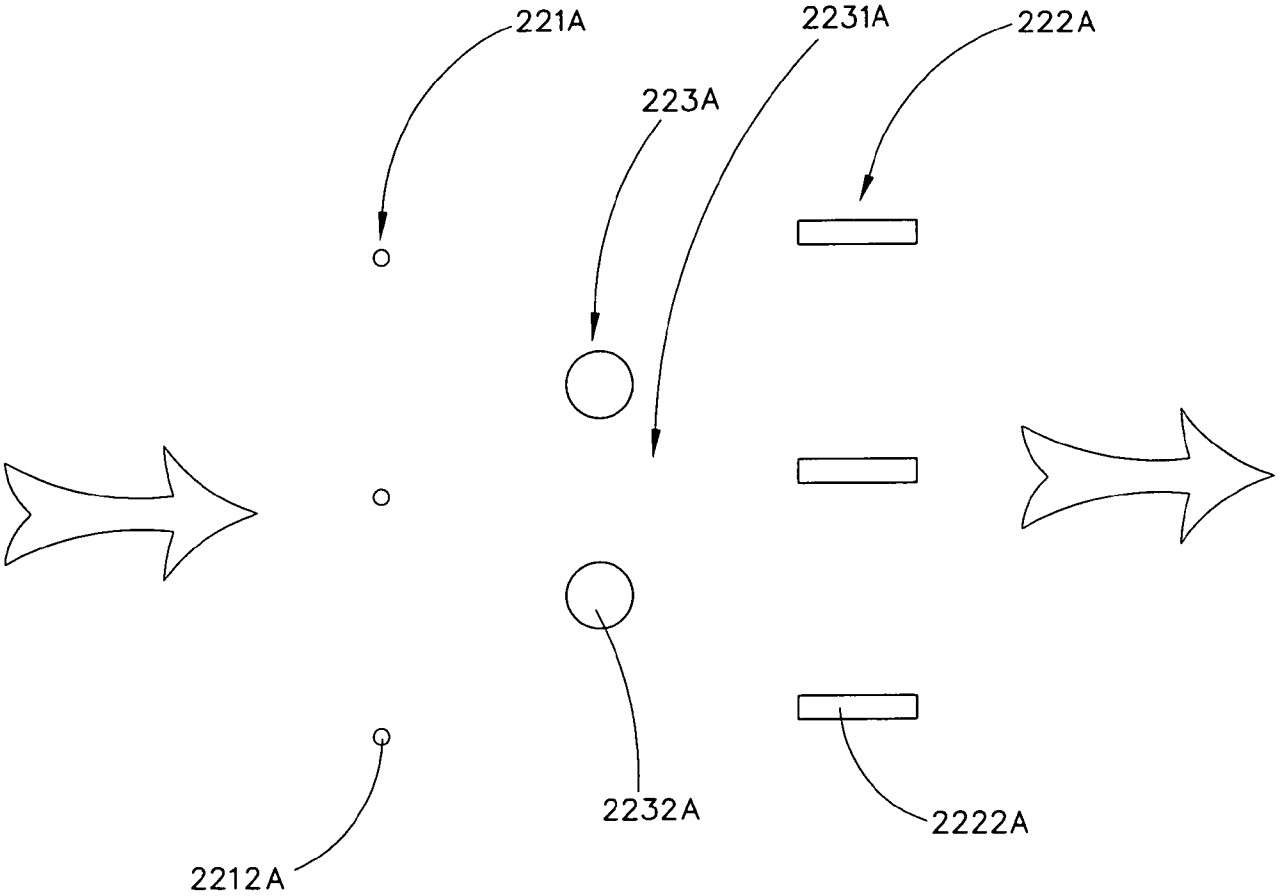

Referring to FIG. 5A and FIG. 5B of the drawings, a third alternative mode of the air purifier according to the above-mentioned preferred embodiment of the present invention is illustrated. The third alternative mode is similar to the preferred embodiment except the first through third electrode set 221A, 222A, 223A. According to the third alternative mode, each of the first electrode elements 2212A is an electrode wire supported within the air purifying cavity 11 at the air inlet 12, wherein each of the second electrode elements 2222A is an electrode blade supported within the air purifying cavity 11 at the air outlet 13, wherein each of the third electrode elements 2232A is an electrode shaft, having an electrode surface smaller than an electrode surface of the electrode blade, supported within the air purifying cavity 11 at a position between the electrode wire and the second electrode blade. Moreover, at least one of the second electrode elements 2222A is aligned with one of the third air channels 2231A.

From the forgoing descriptions, it can be shown that the above-mentioned objects have been substantially accomplished. The present invention provides an air purifier comprising the plurality of electrode sets 221, 222, 223 which is capable of removing dirt from ambient air while releasing ozone at the same time.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An air purifier for removing particles in air, comprising:

an outer casing having an air purifying cavity, an air inlet and an air outlet communicating said air purifying cavity with an exterior of said outer casing;

an ionizer module for purifying said air and for generating ozone, which comprises:

a power unit supported within said outer casing; and an ionizing electrode unit, which is electrically connected to said power unit, comprising a first electrode set as an electrode terminal disposed within said outer casing at said air inlet, a second electrode set disposed within said outer casing at said air outlet, and a third electrode set disposed within said outer casing at a position between said first and second electrode set, wherein a voltage of said third electrode set is higher than a voltage of said first electrode set for drawing said air from said first electrode set to said third electrode set, and said voltage of said third electrode set is lower than a voltage of said second electrode set for accelerating said air from said third electrode set to said second electrode set, such that when said ionizing electrode unit is arranged for effectively drawing said air from said air inlet to said air outlet through said air purifying cavity, said third electrode set forms a first particles remover for electro-statically attracting said particles in said air while said second electrode set forms a second particle remover for electro-statically attracting the remaining particles left from said third electrode set so as to substantially purify said air and to enhance an ozone level thereof.

2. The air purifier, as recited in claim 1, wherein a potential difference between said first and second electrode sets is at least two times more than a potential difference between said first and third electrode sets, such that said first and third electrode sets are adapted for drawing said air through said air inlet while said third and second electrode sets are adapted for accelerating said air towards said air outlet.

3. The air purifier, as recited in claim 1, wherein said first, second and third electrode sets are electrically arranged in such a manner that said third electrode set is negative with respect to said first electrode set, while said third electrode set is positive with respect to said second electrode set, such that said first, second and third electrode set are adapted for ionizing said air within said air purifying cavity to release ozone and to electro-statically attract said particles in said air on said second and third electrode sets.

4. The air purifier, as recited in claim 2, wherein said first, second and third electrode sets are electrically arranged in such a manner that said third electrode set is negative with respect to said first electrode set, while said third electrode set is positive with respect to said second electrode set, such that said first, second and third electrode set are adapted for ionizing said air within said air purifying cavity to release ozone and to electro-statically attract said particles in said air on said second and third electrode sets.

5. The air purifier, as recited in claim 1, wherein said first electrode set comprises a plurality of first electrode elements spacedly formed in an array to define a first air channel between each said two first electrode elements, wherein said second electrode set comprises a plurality of second electrode elements spacedly formed in an array to define a second air channel between each said two second electrode elements, wherein said third electrode set comprises a plurality of third electrode elements spacedly formed in an array to define a third air channel between each said two third electrode elements, wherein number of said first elements is equal to number of said second elements.

6. The air purifier, as recited in claim 2, wherein said first electrode set comprises a plurality of first electrode elements spacedly formed in an array to define a first air channel between each said two first electrode elements, wherein said second electrode set comprises a plurality of second electrode elements spacedly formed in an array to define a second air channel between each said two second electrode elements, wherein said third electrode set comprises a plurality of third electrode elements spacedly formed in an array to define a third air channel between each said two third electrode elements, wherein number of said first elements is equal to number of said second elements.

7. The air purifier, as recited in claim 4, wherein said first electrode set comprises a plurality of first electrode elements spacedly formed in an array to define a first air channel between each said two first electrode elements, wherein said second electrode set comprises a plurality of second electrode elements spacedly formed in an array to define a second air channel between each said two second electrode elements, wherein said third electrode set comprises a plurality of third electrode elements spacedly formed in an array to define a third air channel between each said two third electrode elements, wherein number of said first elements is equal to number of said second elements.

8. The air purifier, as recited in claim 5, wherein at least one of said third electrode elements is aligned with one of said first air channels.

9. The air purifier, as recited in claim 6, wherein at least one of said third electrode elements is aligned with one of said first air channels.

10. The air purifier, as recited in claim 7, wherein at least one of said third electrode elements is aligned with one of said first air channels.

11. The air purifier, as recited in claim 10, wherein each of said first electrode elements is an electrode wire supported within said air purifying cavity at said air inlet, wherein each of said second electrode elements is a second electrode blade supported within said air purifying cavity at said air outlet, wherein each of said third electrode elements is a third electrode blade, having an electrode surface larger than an electrode surface of said second electrode blade, supported within said air purifying cavity at a position between said electrode wire and said second electrode blade.

12. The air purifier, as recited in claim 11, wherein at least one of said second electrode elements is aligned with one of said third air channels.

13. The air purifier, as recited in claim 10, wherein each of said first electrode elements is an electrode wire supported within said air purifying cavity at said air inlet, wherein each of said second electrode elements is an electrode blade supported within said air purifying cavity at said air outlet, wherein each of said third electrode elements is an electrode shaft, having an electrode surface smaller than an electrode surface of said second electrode blade, supported within said air purifying cavity at a position between said electrode wire and said electrode blade.

14. The air purifier, as recited in claim 13, wherein at least one of said second air channels is aligned with one of said third air channels.

15. The air purifier, as recited in claim 10, wherein each of said first electrode elements is an electrode shaft supported within said air purifying cavity at said air inlet, wherein each of said second electrode elements is a second electrode blade supported within said air purifying cavity at said air outlet, wherein each of said third electrode elements is a third electrode blade, having an electrode surface smaller than an electrode surface of said second electrode blade, supported within said air purifying cavity at a position between said electrode shaft and said second electrode blade.

16. The air purifier, as recited in claim 15, wherein at least one of said second electrode elements is aligned with one of said third air channels.

17. The air purifier, as recited in claim 10, wherein each of said first electrode elements is an electrode wire supported within said air purifying cavity at said air inlet, wherein each of said second electrode elements is an electrode blade supported within said air purifying cavity at said air outlet, wherein each of said third electrode elements is an electrode shaft, having an electrode surface smaller than an electrode surface of said electrode blade, supported within said air purifying cavity at a position between said electrode wire and said second electrode blade.

18. The air purifier, as recited in claim 17, wherein at least one of said second electrode elements is aligned with one of said third air channels.

19. The air purifier, as recited in claim 1, wherein said first, second and third electrode sets are detachably mounted to said outer casing, so as to allow said first, second and third electrode sets to be selectively removed from said outer casing.

20. The air purifier, as recited in claim 12, wherein said first, second and third electrode sets are detachably mounted to said outer casing, so as to allow said first, second and third electrode sets to be selectively removed from said outer casing.

21. The air purifier, as recited in claim 14, wherein said first, second and third electrode sets are detachably mounted to said outer casing, so as to allow said first, second and third electrode sets to be selectively removed from said outer casing.

22. The air purifier, as recited in claim 16, wherein said first, second and third electrode sets are detachably mounted to said outer casing, so as to allow said first, second and third electrode sets to be selectively removed from said outer casing.

23. The air purifier, as recited in claim 18, wherein said first, second and third electrode sets are detachably mounted to said outer casing, so as to allow said first, second and third electrode sets to be selectively removed from said outer casing.

* * * * *